US008899674B2

(12) United States Patent
Yagi

(10) Patent No.: US 8,899,674 B2
(45) Date of Patent: Dec. 2, 2014

(54) CHAIR HAVING A SLIDABLE SEAT PORTION

(71) Applicant: Takagi Seiko Co., Ltd., Nakano-shi, Nagano (JP)

(72) Inventor: Susumu Yagi, Nakano (JP)

(73) Assignee: Takagi Seiko Co., Ltd., Nagano (JP)

( * ) Notice: Subject to any disclaimer, the term of this patent is extended or adjusted under 35 U.S.C. 154(b) by 0 days.

(21) Appl. No.: 14/057,702

(22) Filed: Oct. 18, 2013

(65) Prior Publication Data

US 2014/0239676 A1 Aug. 28, 2014

(30) Foreign Application Priority Data

Feb. 22, 2013 (JP) ..... 2013-032808

(51) Int. Cl.
*A47C 1/034* (2006.01)
*A47C 1/032* (2006.01)
*A47C 1/035* (2006.01)

(52) U.S. Cl.
CPC ..... *A47C 1/035* (2013.01)
USPC ..... 297/84; 297/343

(58) Field of Classification Search
USPC ..... 297/84, 90, 91, 342, 343
See application file for complete search history.

(56) References Cited

U.S. PATENT DOCUMENTS

| | | | | | |
|---|---|---|---|---|---|
| 101,764 | A | * | 4/1870 | Forrendieche | 297/91 |
| 780,771 | A | * | 1/1905 | Alexrad | 297/343 |
| 2,326,910 | A | * | 8/1943 | Young | 297/69 |
| 2,374,848 | A | * | 5/1945 | Wohlk | 297/343 |
| 2,634,796 | A | * | 4/1953 | Fischer | 297/343 |
| 2,808,827 | A | * | 10/1957 | O'Hara | 601/59 |
| 3,567,280 | A | * | 3/1971 | Bradshaw | 297/318 |
| 6,412,870 | B1 | | 7/2002 | Higgins et al. | |
| 6,641,214 | B2 | * | 11/2003 | Veneruso | 297/322 |
| 7,585,018 | B2 | * | 9/2009 | LaPointe et al. | 297/85 L |

FOREIGN PATENT DOCUMENTS

| | | |
|---|---|---|
| JP | 2001-087074 A | 4/2001 |
| JP | 2011-240076 A | 12/2011 |

* cited by examiner

*Primary Examiner* — Milton Nelson, Jr.
(74) *Attorney, Agent, or Firm* — Birch, Stewart, Kolasch & Birch, LLP

(57) ABSTRACT

A chair with a seat portion and a base portion fixed to a floor surface. A seat back is mounted to the seat portion through a hinge portion for rotation with respect to the seat portion with a guide groove formed on side surfaces thereof. The guide groove has a guide pin movably fitted so as to be movable in the front-and-rear direction together with the seat portion with respect to the base portion. A foot stand is rotatably mounted to a front end portion of the seat portion through a second hinge portion with a connecting rod with one end portion rotatably mounted to the foot stand through a third hinge portion and the other end portion rotatably mounted to a lower end portion of the seat back through a fourth hinge portion so as to connect the foot stand and the seat back to each other.

4 Claims, 6 Drawing Sheets

CHAIR HAVING A SLIDABLE SEAT PORTION

CROSS-REFERENCE TO RELATED APPLICATION

This application is based upon and claims the benefit of priority of the prior Japanese Patent Application No. P2013-032808, filed on Feb. 22, 2013, and the entire contents of which are incorporated herein by reference.

FIELD

The present invention relates to a chair in which a seat back thereof can be reclined.

BACKGROUND

There are chairs with reclining seat backs in various fields.

In beauty salons, for example, a washbasin is arranged in the rear of a chair on which a customer is seated. By reclining the seat back of the chair so that the head of the customer is positioned on the washbasin, the head of the customer is washed with shampoo.

If the position of the washbasin is set so that the head of the customer exactly matches it when the seat back is reclined, a distance between the chair and the washbasin is too short, and there is a problem that a hair stylist/barber cannot stand between the customer and the washbasin or perform a job other than shampooing.

Thus, a chair illustrated in Japanese Laid-Open Patent Publication No. 2011-240076 is configured such that if a space where a hair stylist can perform a job is ensured while keeping an interval between the washbasin and the chair, an operation of reclining the seat back and an operation of moving a seat portion rearward are performed at the same time so that the head of the customer is brought close to the washbasin.

Moreover, chairs for an aircraft include one as illustrated in Japanese Laid-Open Patent Publication No. 2001-87074.

This chair is configured such that when the seat back is reclined, the seat portion and a foot stand are moved forward so that the seat back, the seat portion, and the foot stand substantially constitute a horizontal plane.

SUMMARY

At an ophthalmologist, a seat back of a chair on which a patient is seated is reclined, and a doctor goes behind the head of the patient who lies on the back and performs physical examination and treatment. At this time, if an interval between the chair and a wall surface behind the chair is small, when the seat back is reclined, there is no space for the doctor to go in.

If an ordinary chair is used, when the seat back is reclined, the head of the patient is located on the further rear as compared with the position before the seat back is reclined and thus, it is necessary to install the chair so that a space between the chair and the wall surface behind the chair is ensured large in advance.

However, there is a case in which the space between the chair and the wall surface should be small due to a layout of the examination room or the like, and thus a chair with which the head of the patient does not get too close to the wall surface behind the chair when the seat back of the chair is reclined is in demand.

Since the chair in the above described Japanese Laid-Open Patent Publication No. 2011-240076 is configured such that the head is moved rearward by reclining the seat back, the operation is opposite to the operation required at the ophthalmologists.

Moreover, the chair in Japanese Laid-Open Patent Publication No. 2001-87074 is configured such that if the seat back is reclined, the seat portion and the foot stand move forward and the position of the head is not shifted to the rear and thus, the operation required at the ophthalmologists can be performed.

However, with the chair in Japanese Laid-Open Patent Publication No. 2001-87074, a structure of mounting onto a floor is complicated, and the chair is configured to become fully flat, and thus there is a problem that the number of components is large.

The present invention was therefore made in order to solve the above described problems and has an object to provide a chair with a structure with a simple configuration and as few components as possible in which, when a seat back is reclined, the position of a head does not move largely rearward.

According a chair according to the present invention, the chair is provided with a seat portion which is a portion on which a person is seated; a base portion which holds the seat portion slidably in the front-and-rear direction and is fixed to a floor surface; a seat back which is mounted to the seat portion through a hinge portion so as to be rotatable with respect to the seat portion and which has a guide groove formed on each of both side surfaces thereof, the guide groove having a guide pin provided on both side surfaces of the base portion movably fitted so as to be movable in the front-and-rear direction together with the seat portion with respect to the base portion; a foot stand rotatably mounted to a front end portion of the seat portion through a second hinge portion; and a connecting rod with one end portion rotatably mounted to the foot stand through a third hinge portion and the other end portion rotatably mounted to a lower end portion of the seat back through a fourth hinge portion so as to connect the foot stand and the seat back to each other.

An action according to this configuration is as follows. When the seat portion is moved forward, the seat back is rotationally moved rearward by using the hinge portion as an axis. Since the seat back is reclined along a guide portion where the guide pin of the base portion is inserted, the seat back itself moves forward with forward movement of the seat portion. Moreover, since the connecting rod also moves forward, the foot stand is rotationally moved around the second hinge portion, and whereby a lower end portion of the foot stand is raised. When the seat portion is moved forward as described above, the seat back, the seat portion, and the foot stand move forward and thus, the position of a head portion is not allowed to largely move rearward when the seat back is reclined.

Moreover, each of the guide grooves may be characterized to be formed in a curved shape so as to be convex to the rear side.

According to this configuration, a speed at which the seat back reclines can be made slower than the case in which the guide groove is linear. Specifically, if the guide groove is linear in the vertical direction of the seat back, the reclining speed of the seat back is gradually expedited, and there is a concern that a person sitting on the chair becomes uncomfortable. However, in the case of the guide groove in a curved shape so as to be convex to the rear side, since the seat back reclines at a constant speed all the time, it is possible to recline the seat back without making a sitting person uncomfortable.

Moreover, the hinge portion may be characterized to be provided rotatably between a projecting piece projecting upward from a seat surface at a position close to a rear end portion on each of the both side surfaces of the seat portion and a position on the front side close to the lower end portion of the seat back.

According to this configuration, when the seat back is reclined, an interval between the seat back and the seat portion can be eliminated.

According to the present invention, the chair in which, when the seat back is reclined, the position of the head does not largely move rearward can be realized with a simple configuration and fewer components.

DESCRIPTION OF THE EMBODIMENTS

A chair according to the present embodiment will be described by referring to the attached drawings.

Figure 1:
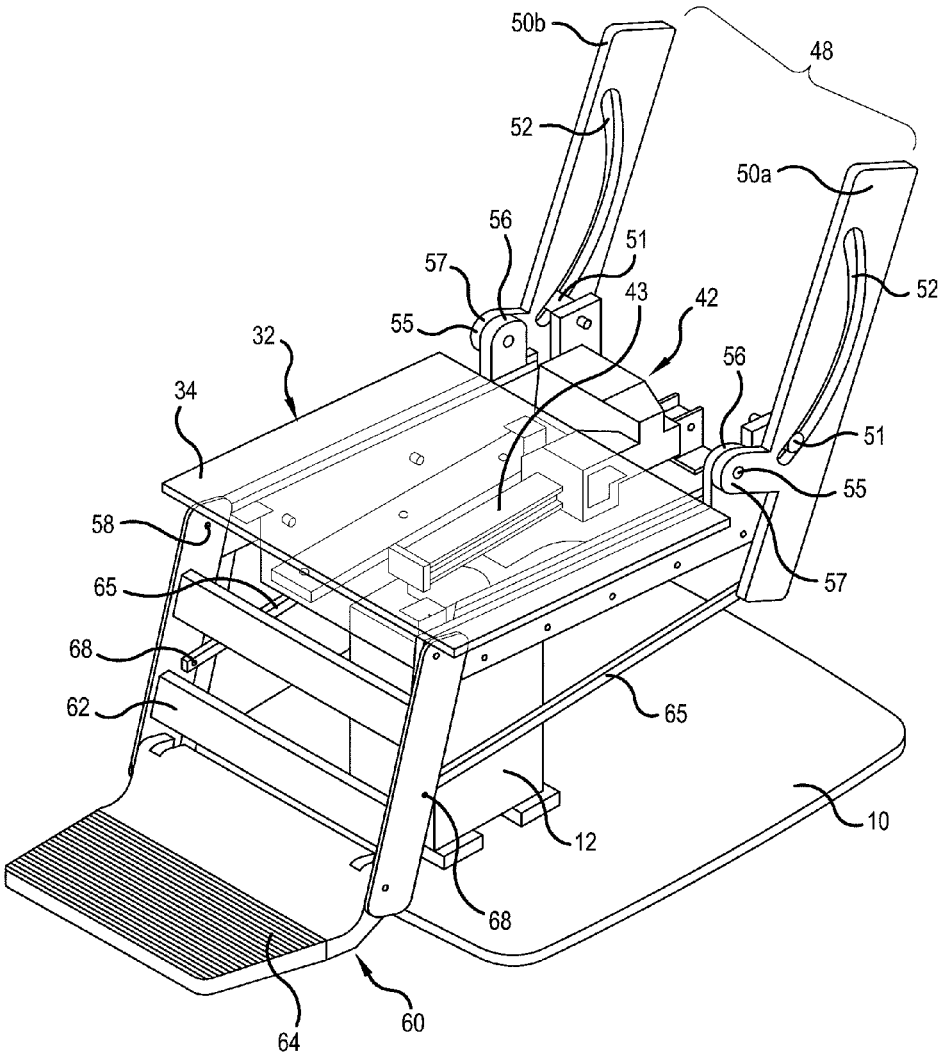
FIG. 1 is a perspective view illustrating an overall configuration of a chair according to the present invention.

FIG. 1 is a perspective view illustrating a configuration of the chair and shows only a framework portion while a cushion portion of a seat back and a cushion portion of a seat portion are omitted. Moreover, the seat portion is made transparent shown by a transparent member so that a portion below the seat portion can be seen.

Figure 2:
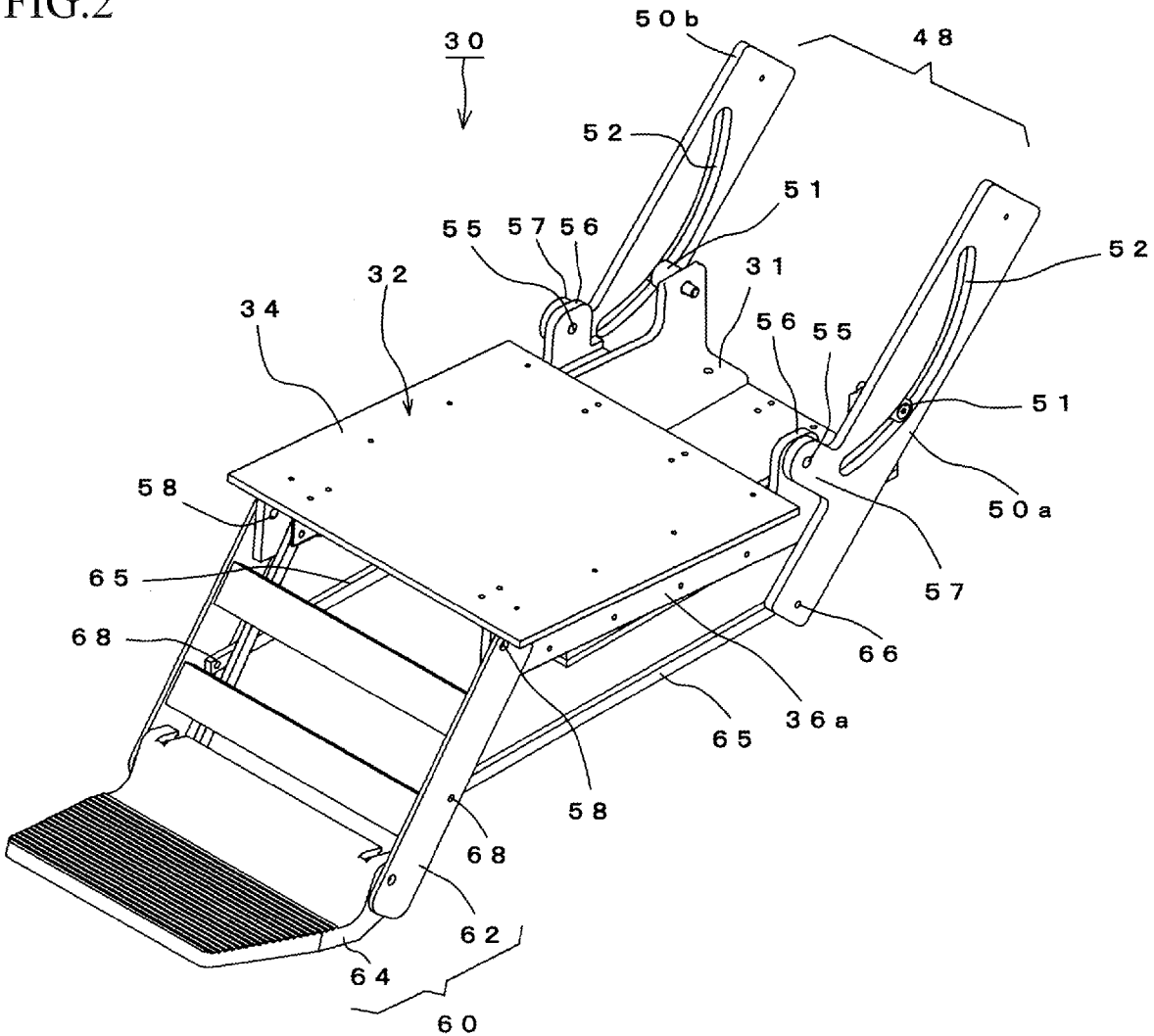
FIG. 2 is a perspective view illustrating a partially omitted configuration of the chair illustrated in FIG. 1.

FIG. 2 illustrates the seat portion in a non-transparent manner, and a leg portion 12 is omitted.

Figure 3:
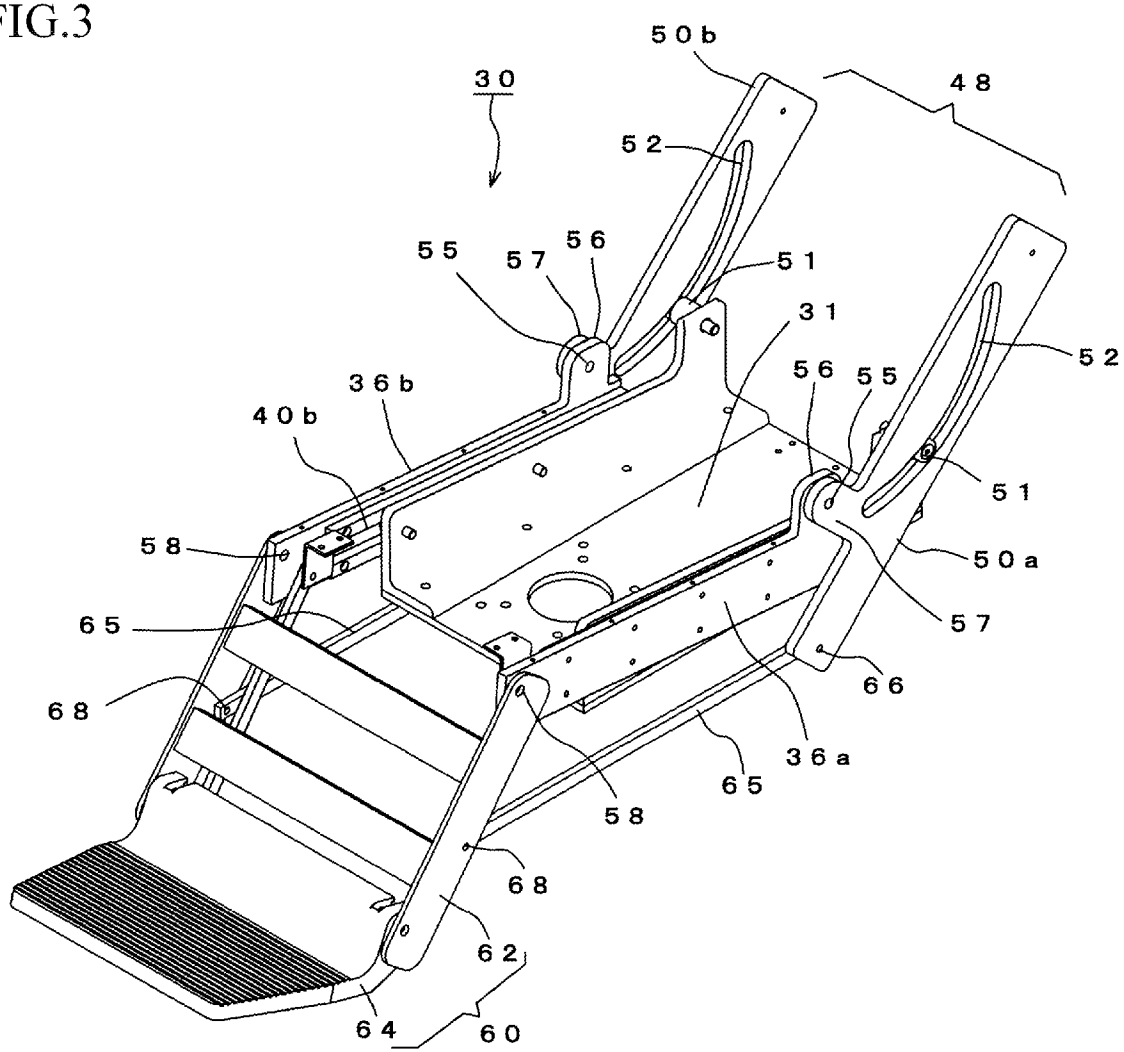
FIG. 3 is a perspective view illustrating a state in which a seat plate is omitted from the chair illustrated in FIG. 2.
Figure 4:
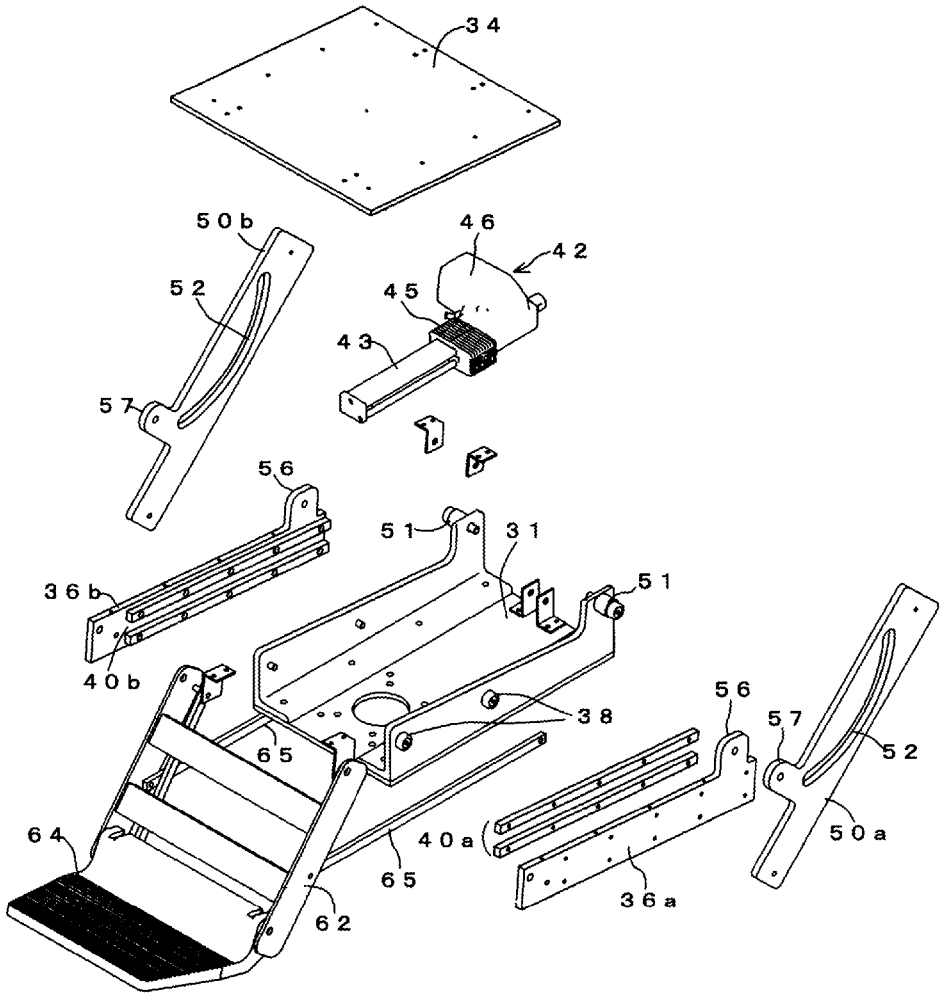
FIG. 4 is an exploded view of an assembly of the chair.

FIG. 3 illustrates a state in which the seat portion is removed from FIG. 2. FIG. 4 is an exploded view of an assembly.

As illustrated in FIG. 1, a chair 30 of the present embodiment is fixed to a floor surface 10 by the leg portion 12. The leg portion 12 is fixed to a lower surface of a base portion 31. The base portion 31 holds a seat portion 32 on which a person is seated slidably in the front-and-rear direction.

The seat portion 32 has a substantially planar-shaped seat plate 34 and side plates 36*a* and 36*b* protruding downward on a lower surface of the seat plate 34 in the vicinity of both left and right end portions.

Inside of each of the both side plates 36*a* and 36*b*, a configuration slidable in the front-and-rear direction between itself and the base portion 31 is provided. Specifically, on the both left and right side faces of the base portion 31, a plurality of guide rollers 38 is provided on each side surface, and inside each of the both side plates 36*a* and 36*b*, roller guides 40*a* and 40*b* capable of sandwiching and rolling the guide rollers 38 are provided. Thus, the seat portion 32 can slide in the front-and-rear direction by being guided by the guide rollers 38 with respect to the base portion 31.

In the present embodiment, the seat portion 32 is provided with inclination so that the front side is located above the rear side. Moreover, in forward movement of the seat portion 32, too, the seat portion 32 is provided so that the front side is located above.

That is, as illustrated in FIG. 4, the two guide rollers 38 are provided on each of the both left and right side surfaces of the base portion 31, and the guide roller located on the front in the two guide rollers is located above the guide roller located on the rear. That is, each of the roller guides 40*a* and 40*b* sandwiching the two guide rollers 38 is inclined in a direction in which the front is above.

Moreover, the both side plates 36*a* and 36*b* on which the roller guides 40*a* and 40*b* are mounted, respectively, and the seat plate 34 are also provided with inclination so that the front side is located above in accordance with an inclination angle of the two guide rollers 38.

Moreover, between the seat portion 32 and the base portion 31, a linear moving device 42 for moving the seat portion 32 in the front-and-rear direction is provided. As the linear moving device 42, a linear actuator or the like can be employed, for example.

The linear actuator 42 is provided with a guide portion 43 having an axis extending in the front-and-rear direction, a movable portion 45 movable along the guide portion 43, and a control portion 46 for moving the movable portion 45 along the guide portion 43.

The control portion 46 can drive the movable portion 45 by converting a rotary motion of a stepping motor to a linear motion.

The movable portion 45 is fixed to the lower surface of the seat portion 32, and the guide portion 43 and the control portion 46 are fixed to the base portion 31. Thus, since the movable portion 45 is moved along the guide portion 43 by means of control of the control portion 46, the seat portion 32 is automatically made movable with respect to the base portion 31.

The linear moving device is not limited to a linear actuator, and a hydraulic cylinder or the like may be employed.

Moreover, a seat back 48 is provided with a back plate (not shown) and back columns 50*a* and 50*b* supporting both left and right sides of the back plate. In the present specification, the back plate of the seat back 48 is omitted and not shown. Each of the back columns 50*a* and 50*b* is a plate-shaped member having a thin width when seen from a front-and-rear direction.

In each of the back columns 50*a* and 50*b*, a guide groove 52 in which the guide roller 51 of the base portion 31 is movably fitted.

The both guide rollers 51 are arranged on the upper side of rear end portions of the both side surfaces of the base portion 31 so that rotary shafts thereof are directed outward to the left-and-right direction.

Each of the guide grooves 52 in the back columns 50*a* and 50*b* is formed in a curved shape so that an upper end portion and a lower end portion are located on the front side of the back columns 50*a* and 50*b*, respectively, and an intermediate portion is located on the rear side of the back columns 50*a* and 50*b*. In other words, each of the guide grooves 52 is formed in a curved shape so as to be convex to the rear side.

By forming each of the guide grooves 52 in a curved shape as above, a speed at which the seat back 48 is reclined can be made slower than the case in which the guide groove has a linear shape.

That is, since at the beginning and the end of reclining of the seat back 48, a moving amount of the guide groove 52 in the width direction becomes larger than that in a longitudinal direction of each of the back columns 50*a* and 50*b*, reclining progresses at a constant speed all the time, which makes it possible to recline the seat back 48 without making a sitting person uncomfortable.

Moreover, each of the back columns 50*a* and 50*b* is connected to the seat portion 32 through a hinge portion 55.

The hinge portion 55 is provided on each of the side plates 36*a* and 36*b* of the seat portion 32. On the rear side of each of the side plates 36*a* and 36*b* of the seat portion 32, a projecting piece 56 projecting upward is formed, and a projecting piece 57 projecting to the front is formed on the upper side of a lower end portion of each of the back columns 50*a* and 50*b*.

The projecting piece 56 of the side plates 36*a* and 36*b* of the seat portion 32 and the projecting piece 57 of the back columns 50*a* and 50*b* are connected by the hinge portion 55.

As described above, since the hinge portion 55 connecting the seat back 48 and the seat portion 32 is provided not between the lower end portion of the seat back 48 and the rear end portion of the seat portion but at a position at least above the lower end portion of the seat back 48 so that the seat back 48 and the seat portion 32 are rotationally moved, when the seat back 48 is reclined and the seat portion is moved forward, an interval between the rear end portion of the seat portion and the lower end portion of the seat back 48 is prevented from being spaced apart.

Subsequently, a configuration on the front side of the seat portion 32 will be described.

On the front side of the seat portion 32, a foot stand 60 rotatably mounted through a front end portion of the seat portion 32 and a second hinge portion 58 is provided rotatably with respect to the seat portion 32.

The foot stand 60 has a leg rest 62 located on a calf portion of a person in a sitting state and a foot rest 64 on which a foot of a person in a sitting state is placed.

The leg rest 62 and the foot rest 64 are mounted rotatably by a fourth hinge portion 66. Specifically, a lower end portion of the leg rest 62 and the foot rest 64 are mounted by the fourth hinge portion 66 so as to become rotatable with respect to each other.

The leg rest 62 of the foot stand 60 is located on the back surface side of the calf of a sitting person when the seat back 48 is in an upright state but does not particularly support the human body. When the seat portion 32 moves forward in a state in which the seat back 48 lies flat, the leg rest 62 rotationally moves so as to become horizontal with the seat portion 32 and is brought into contact with the lower surface of the calf of the person and supports the lower body.

The leg rest 62 in the present embodiment is composed of the both left and right side plates and two connecting plates for connecting the both side plates but this configuration is not particularly limiting.

When the seat back 48 is upright, the foot rest 64 of the foot stand 60 is brought into contact with the bottom of the foot of the sitting person and supports the lower body, and when the seat portion 32 moves forward in a state in which the seat back 48 lies flat, the foot rest 64 rotationally moves so as to become substantially horizontal with the seat portion 32 and is brought into contact with the heel of the person and supports the lower body.

Moreover, the foot stand 60 is configured to interlock with the seat back 48.

That is, the foot stand 60 is connected by a connecting rod 65 extended between the lower end portions of the back columns 50*a* and 50*b* and the foot stand 60 also rotationally moves around the second hinge portion 58 and inclingly moves with inclining movement of the seat back 48.

A rear end portion of the connecting rod 65 is mounted rotatably to the lower end portions of the back columns 50*a* and 50*b* by a third hinge portion 68.

Moreover, a front end portion of the connecting rod 65 is mounted rotatably by the third hinge portion 68 in the vicinity of a middle portion in the vertical direction of the leg rest 62 of the foot stand 60.

Subsequently, an operation of the chair of the present embodiment will be described by referring to FIGS. 5 and 6.

Figure 5:
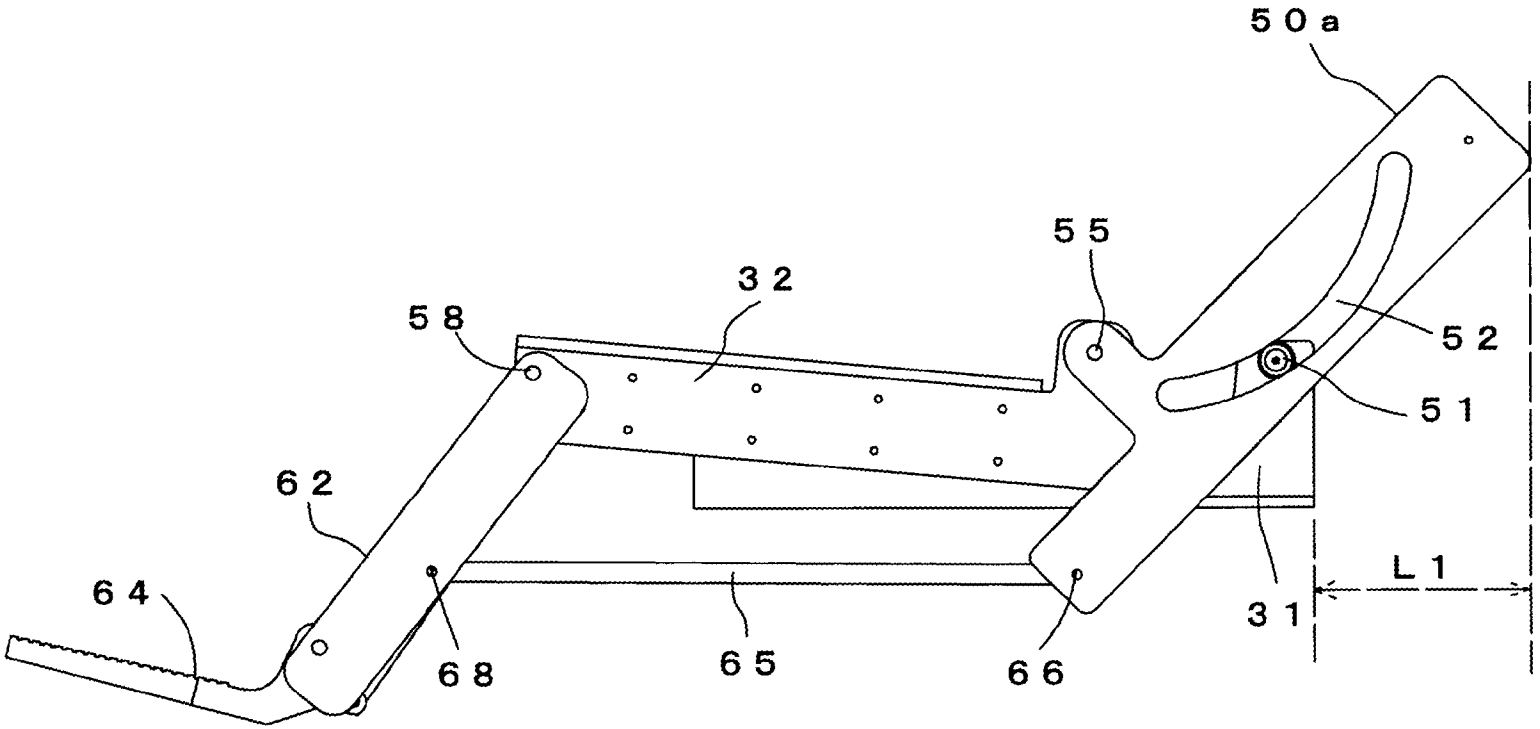
FIG. 5 is a side view illustrating a state in which a seat back is upright.

A state in FIG. 5 illustrates a normal state of the chair 30 and the upper body of the person sitting on the chair is upright.

From this state, the above described linear moving device 42 is driven, and the seat portion 32 is moved forward. Then, the seat back 48 connected to the seat portion 32 through the hinge portion 55 moves forward with the seat portion 32. When the seat back 48 moves forward, the seat back 48 rotationally moves in a vertical plane around the hinge portion 55. Then, in the guide groove 52 formed in each of the back columns 50*a* and 50*b* of the seat back 48, the guide roller 51 provided on the base portion 31 rolls. As described above, the seat back 48 rotationally moves in a direction to become horizontal with respect to the base portion 31 along the guide groove 52.

When the seat back is reclining to the horizontal direction, the connecting rod 65 mounted to the lower end portions of the back columns 50*a* and 50*b* of the seat back 48 moves to the front, and the foot stand 60 is pushed forward front by the connecting rod 65. When the foot stand 60 is pushed forward by the connecting rod 65, the leg rest 62 rotationally moves forward around the second hinge portion 58 in the vertical plane.

Moreover, the foot rest 64 mounted to the lower end portion of the leg rest 62 is regulated so that the distal end portion is not inclined downward from the horizontal plane and is located substantially horizontally when the leg rest 62 stands upright and is also regulated so that the foot rest 64 is located substantially horizontally even when the leg rest 62 gets close to horizontal.

Figure 6:
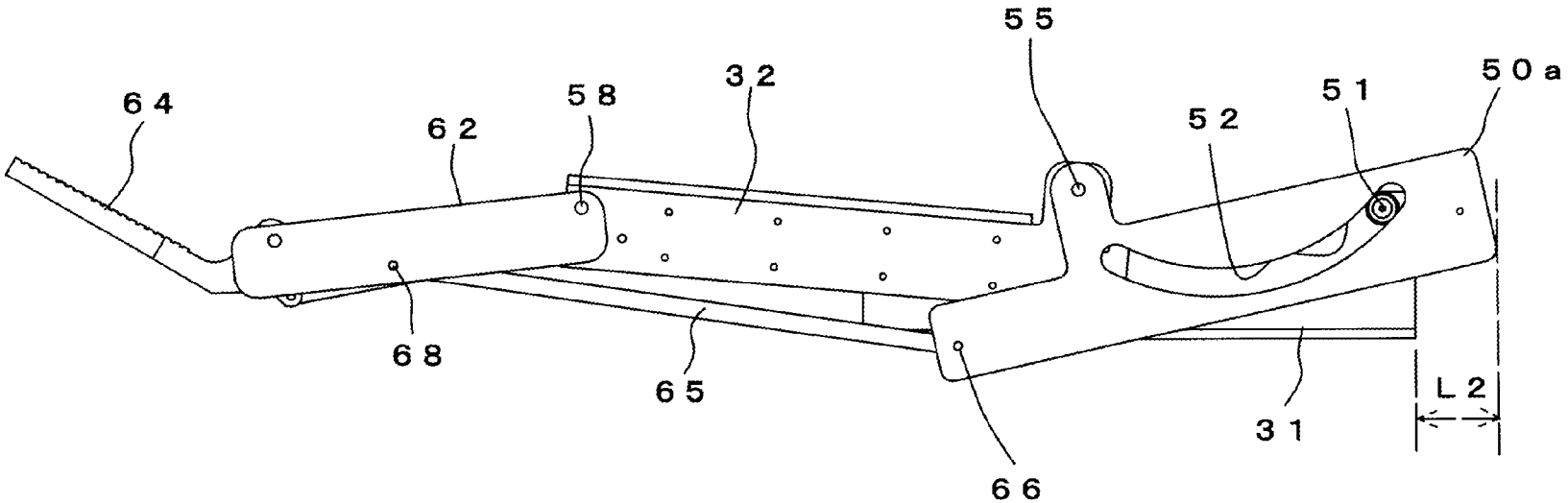
FIG. 6 is a side view illustrating a state in which the seat back is laid.

FIG. 6 illustrates a state in which the seat back 48 is reclined.

At this time, the seat back 48, the seat portion 32, the leg rest 62, and the foot rest 64 become substantially horizontal, respectively, into a substantially fully flat state.

A distance between the upper end portion of the seat back 48 and the guide roller 51 of the base portion 31 at this time is L2, and L2 is shorter than a distance L1 from the guide roller 51 when the seat back 48 in FIG. 5 is in an upright state. That is, in the chair according to the present invention, since the seat back 48 moves forward with the forward movement of the seat portion while reclining, the head of a person sitting on the chair can be prevented from moving rearward when the seat back 48 is reclined. In the present embodiment, by forward movement of the seat portion and the seat back, the head of a person can move more forward than the case in which the seat back is upright (L1>L2).

In the present embodiment, the example in which the seat portion is moved forward by using the linear moving device is explained. However, provision of some driving means for moving the seat portion forward is not indispensable and the seat portion may be moved manually.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention has been described in detail, it should be understood that the various changes, substitutions, and alternations could be made hereto without departing from the spirit and scope of the invention.

What is claimed is:

1. A chair comprising:

a seat portion which is a portion on which a person is seated;

a base portion which holds the seat portion slidably in the front-and-rear direction and is fixed to a floor surface;

a seat back which is mounted to the seat portion through a hinge portion so as to be rotatable with respect to the seat portion and which has a guide groove formed on each of both side surfaces thereof, the guide groove having a guide pin provided on both side surfaces of the base portion movably fitted so as to be movable in the front-and-rear direction together with the seat portion with respect to the base portion;

a foot stand rotatably mounted to a front end portion of the seat portion through a second hinge portion; and a connecting rod with one end portion rotatably mounted to the foot stand through a third hinge portion and the other end portion rotatably mounted to a lower end portion of the seat back through a fourth hinge portion so as to connect the foot stand and the seat back to each other.

2. The chair according to claim 1, wherein said hinge portion is provided rotatably between a projecting piece projecting upward from a seat surface at a position close to a rear end portion on each of the both side surfaces of the seat portion and a position on a front side close to the lower end portion of the seat back.

3. The chair according to claim 1, wherein each of said guide grooves is formed in a curved shape so as to be convex to the rear side.

4. The chair according to claim 3, wherein said hinge portion is provided rotatably between a projecting piece projecting upward from a seat surface at a position close to a rear end portion on each of the both side surfaces of the seat portion and a position on a front side close to the lower end portion of the seat back.

* * * * *